United States Patent [19]

Lieberman et al.

[11] Patent Number: 4,985,959

[45] Date of Patent: Jan. 22, 1991

[54] END SUPPORTS FOR PAINT ROLLER ASSEMBLY

[75] Inventors: Harry A. Lieberman, Haverford, Pa.; Kenneth R. Stoddart, Fond du Lac, Wis.

[73] Assignee: RAF Industries, Inc., Elkins Park, Pa.

[21] Appl. No.: 24,142

[22] Filed: Mar. 10, 1987

[51] Int. Cl.[5] ..... B05C 17/02

[52] U.S. Cl. ..... 15/230.11; 29/116.1; 300/21; 401/197; 401/208; 403/165; 403/326; 403/365

[58] Field of Search ..... 15/230.11; 29/116 R, 29/123–124; 300/21; 403/165, 326, 365, 371–372; 401/197, 208

[56] References Cited

U.S. PATENT DOCUMENTS

| | | | |
|---|---|---|---|
| 2,356,842 | 8/1944 | Helmond . | |
| 2,496,700 | 2/1950 | Cole | 74/543 |
| 2,735,128 | 2/1956 | Adams . | |
| 2,763,022 | 9/1956 | Glacken . | |
| 2,766,473 | 10/1956 | Thackara . | |
| 2,891,301 | 6/1959 | Conklin . | |
| 2,935,757 | 5/1960 | Phillips . | |
| 3,094,770 | 6/1963 | Williams . | |
| 3,119,137 | 1/1964 | Schueler . | |
| 3,202,258 | 8/1965 | Isaksen . | |
| 3,711,887 | 1/1973 | Chapman | 15/230.11 |
| 3,774,278 | 11/1973 | Ashton . | |
| 3,815,196 | 6/1974 | Gotham et al. | 29/116 R |
| 3,910,627 | 10/1975 | Meyer . | |
| 4,097,164 | 6/1978 | Campbell | 403/372 |
| 4,495,683 | 1/1985 | Delhaes | 29/123 |

FOREIGN PATENT DOCUMENTS

| | | | |
|---|---|---|---|
| 1402540 | 5/1965 | France | 15/230.11 |
| 1451378 | 7/1966 | France | 401/197 |

*Primary Examiner*—Philip R. Coe
*Assistant Examiner*—Stephen F. Gerrity
*Attorney, Agent, or Firm*—Foley & Lardner, Schwartz, Jeffery, Schwaab, Mack, Blumenthal & Evans

[57] ABSTRACT

End support members mountable at each end of a paint-applying cover sleeve and adapted to receive the axle of a roller handle. Each support comprises a central hub which defines a chamber greater in diameter being the axle of a handle member. A radially expansible split tube is positioned in the chamber. The interior diameter of the split tube prior to expansion is smaller than the diameter of an axle and the outer diameter is smaller than the inner diameter of said chamber. When the axle is inserted into the split tube the latter expands radially outwardly and exerts radially inward pressure on the axle to frictionally retain the axle in its longitudinally adjusted position.

9 Claims, 2 Drawing Sheets

END SUPPORTS FOR PAINT ROLLER ASSEMBLY

FIELD OF THE INVENTION

The present invention relates as indicated to end supports for a paint roller assembly, and relates more particularly to uniquely constructed end supports which function to frictionally engage the axle rod of the roller handle when the rod is inserted through the end supports. The end supports are positioned within the respective ends of a roller in a well-known manner.

BACKGROUND OF THE INVENTION

Paint roller assemblies are well-known in the art, with many different designs being available. Most are characterized by the application of a cylindrical cover to a support structure through which the axle rod of the handle extends to permit rotation of the cover relative to the rod for the application of paint to a surface. To accomplish this general objective, various designs have been utilized, including wooden cores or spindles, cage-type support frames comprised of wire metal over which the rollers are frictionally mounted, and end support arrangements in which the supports engage the respective ends of the roller cylinder and receive and support the axle rod of the roller assembly handle.

An example of the end support-type construction is disclosed in U.S. Pat. No. 3,711,887 in which end supports are frictionally retained at both ends of the roller cylinder, with the end supports adapted to frictionally receive bearing elements formed on the axle rod. U.S. Pat. No. 3,094,770 to Williams also shows an end support arrangement in which the axle rod is retained in place on the end supports by a retaining screw which is further received in the adjacent interiorly threaded end of the axle rod. U.S. Pat. Nos. 2,766,473 to Thackara and 2,891,301 to Conklin disclose end support members which are constructed and arranged to retain the axle rod in place by engaging an annular groove formed in the axle rod.

All of the paint roller assemblies known to applicant have certain disadvantages. They are frequently difficult to assemble and disassemble; the economies of manufacture are not such that the roller and end supports can be made disposable, and they frequently do not eliminate the dripping of paint from the exterior of the end support members.

SUMMARY OF THE INVENTION

In accordance with the present invention, end support members are secured to the roller sleeve at the ends thereof, and permit the roller handle member to be quickly, easily and firmly retained in place in the end supports, or easily removed therefrom when it is desired to clean or replace the roller sleeve. The handle member is constructed and arranged to be easily cleaned when removed from the end support mounting thereof, and the end supports are provided with exterior flat surfaces which resist the accumulation of liquid paint, either on the surface or between the supports and the roller sleeve.

The uniquely designed end supports are press-fitted into the opposite ends of the roller sleeve, and are provided with radially enlarged bearing hub portions through which the handle extends. The end supports are essentially identical except that the inner support is formed with an axle hole to receive the axle of the handle member, whereas the oppositely disposed or outer end support is entirely closed, with the handle member, when properly mounted, being spaced from the closed end of the support.

The bearing hub of each end support is radially enlarged and defines a cylindrical chamber substantially greater in diameter than the diameter of the axle of the handle member which extends through the bearing hub. Positioned within each bearing hub and enveloping and firmly retaining the axle member is a split tube member through which the axle member extends and expands into tight frictional engagement with the inner bearing surface of the bearing hub. When the axle has been moved to its operative position, the split tubes thus relatively firmly and frictionally retain the axle member in place. The axle member is provided with a domed leading end to facilitate passage through the split tubes, and the split tubes themselves are provided with both inwardly and outwardly tapered end surfaces to facilitate reception of the axle member and to facilitate the positioning of the split tubes within the bearing hubs prior to positioning the axle member through the end supports.

The radial outer surfaces of the end support members are embossed at arcuately spaced locations so as to frictionally retain the end supports in the cover sleeve. When the useful life of the roller sleeve has been reached, the end supports can be removed from the cover sleeve for reuse, or the entire assembly discarded, with the disposal being made feasible by the economic manufacture of the assembly.

These and other objects of the invention will become apparent as the following description proceeds, in particular reference to the application drawings.

DETAILED DESCRIPTION OF THE PREFERRED EMBODIMENTS

Figure 1:
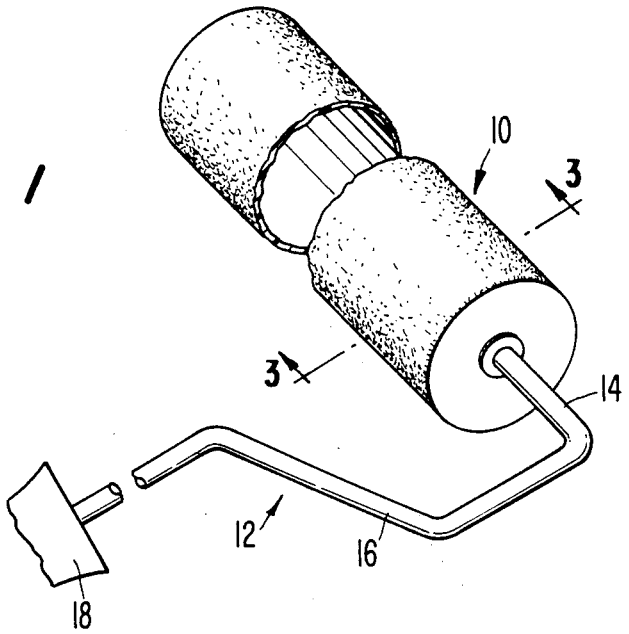
FIG. 1 is a perspective view, partially broken, showing the paint roller assembly, with end supports, receiving the axle of a handle member.
Figure 2:
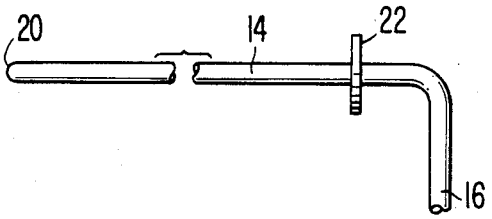
FIG. 2 is a side elevational, fragmentary view of the axle portion of the handle member.

Referring to the application drawings, in which like parts are indicated by like reference numerals, a complete paint roller assembly generally indicated at 10 is illustrated in FIG. 1, to which is connected a handle member generally indicated at 12. The handle member includes an axle 14 and a curved section 16 interconnecting the axle 14 to a gripping handle 18 of construction and type which forms no part of the present invention. As shown in FIG. 2, the axle member includes a domed end portion to facilitate insertion of the axle through the end supports, and a washer or flange 22 is integrally formed or mounted on the exterior of the axle member near the junction thereof with the section 16 to serve as a stop when the axle is inserted into the roller assembly.

The roller assembly 10 includes a sleeve 24 to which is applied fabric or the like 26 conventionally employed for paint roller surfaces. The sleeve 24 and fabric 26 per se form no part of the present invention.

Figure 3:
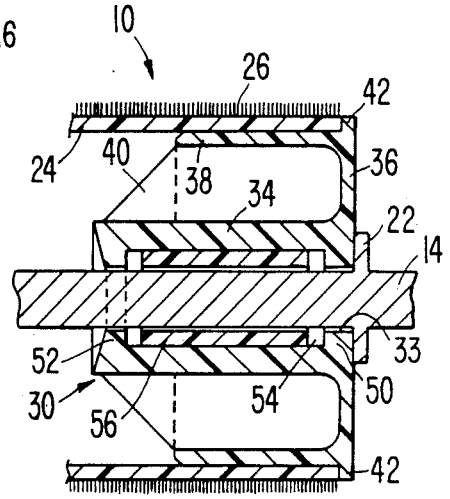
FIG. 3 is a sectional view taken on line 3—3 of FIG. 1.
Figure 4:
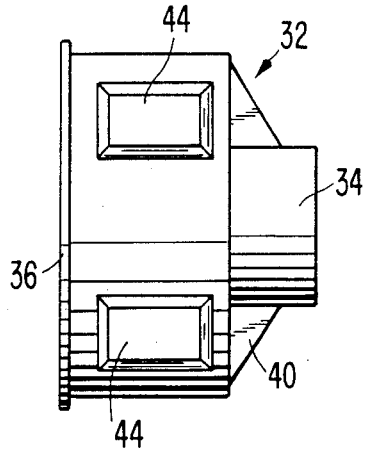
FIG. 4 is a side elevational view of the outer end support member.
Figure 5:
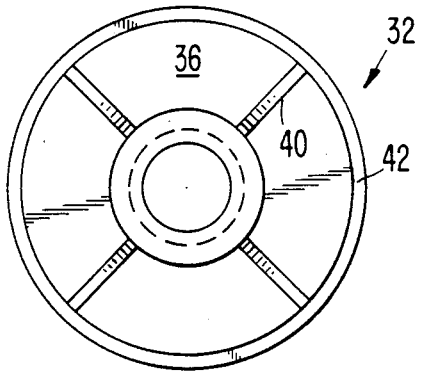
FIG. 5 is an end elevational view of the end support member shown in FIG. 4.

The roller assembly 10 includes end support members generally indicated at 30 in FIG. 3 and 32 in FIGS. 4 and 5. The end support 30 is identical to the support 32 except that it is formed with an opening 33 in the outer end wall 36 to receive the axle 14, whereas the outer end wall of the end support 32, which is positioned at the opposite end of the roller assembly, is entirely closed. It will be understood that except for that distinction, description of one support will apply equally to the other.

The end support 30 comprises a central hub 34, the end wall 36, and a peripheral flange 38. In the form shown, reinforcing webs 40 interconnect the hub 34 with the flange 38. Although web reinforcement may not be necessary as shown, the webs are spaced approximately 90 degrees apart, as shown in FIG. 5.

The end wall 36 has an outer peripheral edge 42 which extends radially beyond the outer surface of the flange 38, for engaging the end of the sleeve cover 24. This serves to accurately position the end support, and to prevent inadvertent movement of the end support relative to the cover.

Projections or embossments commonly indicated at 44 are formed on and extend radially outwardly from the periphery of the flange 38 so as to enhance the frictional fitting of the end support in the cover sleeve. The end support is preferably molded from a relatively firm, yet resilient plastic material which permits very slight radially inward compression of the flange 38 when the support is mounted in the sleeve cover. In this manner, the projections 44 tightly engage the adjacent surface of the cover and retain the end support in place. It will be understood that the mounting of the end support 32 in the opposite end of the cover sleeve is accomplished in the same manner.

The hub 34 is formed with radially inwardly directed outer and inner shoulders 50 and 52, respectively. The opening 33 is defined by the outer shoulder 50 and is sufficient in size to accommodate the axle 14 of the handle, as is the diameter of the opening defined by the inner shoulder 52. The shoulders 50 and 52, and the inner surface of the hub body define a chamber 54, the diameter of which is substantially greater than the diameter of the axle 14.

Figure 6:
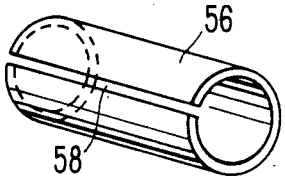
FIG. 6 is a perspective view of the split tube which is positioned within the bearing hub of the end support.
Figure 7:
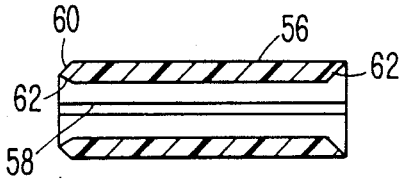
FIG. 7 is a sectional view through the split tube member.

A split tube 56 is positioned in the chamber 54 around the axle 14 to firmly and resiliently engage the same. The split tube 56 is shown in more detail in FIGS. 6 and 7, with the tube being cylindrical except for a longitudinal slit 58 formed in the wall thereof. At the inner end of the split tube 56, shown at the left in FIGS. 6 and 7, there is an outer chamfer or bevel 60 which facilitates the insertion of the split tube into the chamber 54 through the opening defined by either shoulder 50 or shoulder 52. The outer end is not outwardly chamfered to preclude inadvertent withdrawal of the tube. Inner chamfers 62 formed at both ends of the tube serve as cam surfaces which facilitate movement of the dome-shaped end 20 of the axle 14 of the handle when the latter is inserted into or withdrawn from the roller assembly. The specific chamfer angle for the surfaces 60 and 62 can be selected as desired in order to achieve the desired results.

The split tube 56 is preferably formed of relatively rigid, yet expansible plastic material, with plastic sold under the brand name CELCON, being satisfactory. In its relaxed, unexpanded condition, the split tube can be inserted into the chamber 54 as described. The tube can be radially compressed to a slight degree, equal to the width of the slot 58, during the insertion of the tube into the chamber. In its relaxed state, the inner diameter of the split tube is smaller than the outside diameter of the axle 14 of the handle member. Thus, the split tube is caused to radially expand when the axle is inserted therethrough as shown in FIG. 3. This expansion creates a tensional force which acts on the axle to frictionally retain the same in its operative position without, however, significantly restricting rotation of the roller sleeve and end supports about the axis of the axle during use of the roller assembly. The relative diameters of the shaft 14, split tube 56, and chamber 54 are such that the axle can be inserted through the split tube with slight resistance, but the radially inward force exerted by the split tube on the axle frictionally grips the axle during operation of the roller.

The assembly and use of the invention should be apparent from the foregoing description. The end supports 30 and 32 are mounted on the cover sleeve, and the axle 14 thereafter inserted through the end rollers 30 and 32. As the axle is inserted, the split tube 56 in both of the end support members radially expands and exerts a radially inward force on the axle. The axle is inserted into the roller assembly, to the left as shown in FIG. 3, until the washer or flange 22 engages the adjacent end wall 36 of the end support, at which time the leading end 20 of the axle is inwardly spaced from the closed end wall of the end support 32.

When it is desired to remove the roller assembly from the handle for cleaning or replacement, the handle is simply withdrawn from the assembly, accomplished by movement to the right as shown in FIG. 3, with the pulling force overcoming the frictional force between the split tubes and the axle. The handle can thus be quickly and easily removed and cleaned for further use. During operation, the flat ends of the end support members and the frictional engagement of the end supports in the cover sleeve inhibit the accumulation of paint on the end support members, which accumulation is a decided disadvantage in many roller assemblies currently in use. Moreover, should economies permit, the roller assembly can, after removal of the handle member, simply be disposed of and a new roller assembly assembled with the handle member after the latter has been cleaned.

What is claimed is:

1. End support members adapted to be tightly frictionally mounted at each end of a paint-applying cover sleeve and adapted to receive the axle of a handle member, each end support member comprising:

(a) a flat outer end wall;

(b) a longitudinally extending central hub having at least one end opening, said opening being formed by a radially inwardly directed annular shoulder having a diameter slightly greater than the diameter of an axle of a handle member; said shoulder, the inner surface of said hub, and all or a part of said end wall defining a chamber which is substantially greater in diameter than the diameter of an axle of a handle member;

(c) an outer annular flange carried by said end wall and adapted to tightly frictionally engage the inner surface of a cover sleeve, and (d) a radially expansible split tube positioned in said chamber and longitudinally limited in movement by said shoulder and by all or part of said end wall, the interior diameter of said split tube prior to expansion being smaller than the diameter of an axle of a handle member, and the outer diameter of said split tube being smaller than the inner diameter of said chamber, whereby insertion of the axle into the longitudinally confined split tube results in radially inward pressure being applied by said tube to the axle to frictionally retain the same in its longitudinal position.

2. The end support structure of claim 1 wherein said central hub is formed at the outer end with a radially inwardly directed shoulder coplanar with said outer end wall, said shoulder defining an outer opening having a diameter slightly greater than the diameter of an axle of a handle member so as to accommodate insertion of the axle through said central hub.

3. The end support structure of claim 2, wherein said outer end wall includes a radially outer annular shoulder extending radially beyond said outer annular flange, said shoulder being adapted to engage the end face of the cover sleeve to form a stop contact where the end support is mounted in place.

4. The end support structure of claim 1 further including reinforcing webs structurally interposed between and connected to said central hub and said outer annular flange for rigidifying the end support member.

5. The end support structure of claim 1, wherein said outer annular flange is formed with circumferentially spaced projections extending outwardly from the surface thereof, which projections firmly engage the cover sleeve when the end support member is positioned so as to hold the same in place.

6. The end support structure of claim 1, wherein an end support member mounted at the end of the cover sleeve where the axle of the handle member is inserted is formed with an opening through which the axle can extend when the handle member is positioned in the support members, and a second end support member mounted at the other end of said cover sleeve has an end face which is entirely closed.

7. The end support structure of claim 1, wherein said split tube is beveled or chamfered on the interior surface of both ends thereof to facilitate entry of the axle of the handle member during insertion of the handle.

8. The end support structure of claim 7, wherein said split tube is also beveled inwardly on its outer surface at its inner end to facilitate positioning of the split tube in the chamber of the central hub.

9. A paint roller assembly comprising the combination of:

(a) a handle member having an axle;

(b) a paint-applying cover sleeve adapted to rotate about the axis of the axle of the handle member, and (c) end support members adapted to be tightly frictionally mounted at each end of said paint-applying cover sleeve and adapted to receive said axle of said handle member, each end support member comprising:

(1') a flat outer end wall;

(2') a longitudinally extending central hub having at least one end opening, said opening being formed by a radially inwardly directed annular shoulder having a diameter slightly greater than the diameter of an axle of a handle member; said shoulder, the inner surface of said hub, and all or a part of said end wall defining a chamber which is substantially greater in diameter than the diameter of an axle of a handle member;

(3') an outer annular flange carried by said end wall and adapted to tightly frictionally engage the inner surface of a cover sleeve, and (4') a radially expansible split tube positioned in said chamber and longitudinally limited in movement by said shoulder and by all or part of said end wall, the interior diameter of said split tube prior to expansion being smaller than the diameter of an axle of a handle member, and the outer diameter of said split tube being smaller than the inner diameter of said chamber, whereby insertion of the axle into the longitudinally confined split tube results in radially inward pressure being applied by said tube to the axle to frictionally retain the same in its longitudinal position.

* * * * *